US008931413B2

(12) United States Patent
Rastegar et al.

(10) Patent No.: US 8,931,413 B2
(45) Date of Patent: Jan. 13, 2015

(54) COMPACT MECHANICAL INERTIA IGNITERS FOR THERMAL BATTERIES AND THE LIKE

(71) Applicants: Jahangir S Rastegar, Stony Brook, NY (US); Richard T Murray, Patchogue, NY (US); Thomas Spinelli, Northport, NY (US)

(72) Inventors: Jahangir S Rastegar, Stony Brook, NY (US); Richard T Murray, Patchogue, NY (US); Thomas Spinelli, Northport, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 0 days.

(21) Appl. No.: 14/146,269

(22) Filed: Jan. 2, 2014

(65) Prior Publication Data

US 2014/0305326 A1 Oct. 16, 2014

Related U.S. Application Data

(62) Division of application No. 12/955,876, filed on Nov. 29, 2010, now Pat. No. 8,651,022.

(51) Int. Cl.
*F42C 15/24* (2006.01)

(52) U.S. Cl.
CPC ..... *F42C 15/24* (2013.01)
USPC ..... 102/249; 102/247; 102/221

(58) Field of Classification Search
USPC ..... 102/221, 216, 226, 222, 227, 247, 249, 102/251, 252, 253, 254, 256, 272, 274, 275, 102/202.1
See application file for complete search history.

(56) References Cited

U.S. PATENT DOCUMENTS

| | | | | | |
|---|---|---|---|---|---|
| 2,475,730 | A * | 7/1949 | Wandrey | 74/1.5 |
| 2,915,604 | A * | 12/1959 | Rabinow et al. | 200/61.45 R |
| 2,981,191 | A * | 4/1961 | Kopec | 102/264 |
| 4,464,992 | A * | 8/1984 | Bell | 102/275 |
| 4,506,606 | A * | 3/1985 | Caruso | 102/487 |
| 4,927,172 | A * | 5/1990 | Motozawa | 280/734 |
| 5,024,157 | A * | 6/1991 | Nishikawa | 102/252 |
| 5,104,145 | A * | 4/1992 | Fohl | 280/734 |
| 5,142,922 | A * | 9/1992 | Sakamoto et al. | 74/2 |
| 5,193,407 | A * | 3/1993 | Sakamoto et al. | 74/2 |
| 5,357,816 | A * | 10/1994 | Sakamoto et al. | 74/2 |
| 5,363,710 | A * | 11/1994 | Sakamoto | 74/2 |
| 5,483,846 | A * | 1/1996 | Sakamoto et al. | 74/2 |
| 5,670,764 | A * | 9/1997 | Sakamoto et al. | 200/61.45 R |
| 6,129,022 | A * | 10/2000 | Hickey et al. | 102/221 |
| 6,240,848 | B1 * | 6/2001 | Specht et al. | 102/216 |
| 6,431,071 | B1 * | 8/2002 | Hodge et al. | 102/254 |
| 6,459,055 | B1 * | 10/2002 | Russell | 200/61.45 R |
| 7,587,979 | B2 * | 9/2009 | Rastegar et al. | 102/247 |
| 7,762,190 | B1 * | 7/2010 | Laib et al. | 102/205 |
| 8,191,476 | B2 * | 6/2012 | Rastegar et al. | 102/247 |
| 8,418,617 | B2 * | 4/2013 | Rastegar et al. | 102/247 |
| 8,434,408 | B2 * | 5/2013 | Rastegar | 102/247 |
| 2008/0041263 | A1 * | 2/2008 | Rastegar et al. | 102/272 |
| 2010/0132577 | A1 * | 6/2010 | Rastegar | 102/247 |
| 2012/0174810 | A1 * | 7/2012 | Rastegar et al. | 102/247 |
| 2012/0205225 | A1 * | 8/2012 | Rastegar et al. | 200/61.45 R |

* cited by examiner

*Primary Examiner* — Benjamin P Lee

(57) ABSTRACT

A method for igniting a thermal battery upon a predetermined acceleration event. The method including: rotatably connecting a striker mass to a base; aligning a first projection on the striker mass with a second projection on the base such that when the striker mass is rotated towards the base, the first projection impacts the second projection; and preventing impact of the first and second projections unless the predetermined acceleration event is experienced.

5 Claims, 12 Drawing Sheets

COMPACT MECHANICAL INERTIA IGNITERS FOR THERMAL BATTERIES AND THE LIKE

CROSS-REFERENCE TO RELATED APPLICATION

This application is a divisional application of U.S. application Ser. No. 12/955,876 filed on Nov. 29, 2010, the entire contents of which is incorporated herein by reference.

BACKGROUND

1. Field of the Invention

The present disclosure relates generally to mechanical igniters, and more particularly to compact, reliable and easy to manufacture mechanical igniters for thermal batteries and the like that are activated by high-G shocks such as by the gun firing setback acceleration.

2. Prior Art

Thermal batteries represent a class of reserve batteries that operate at high temperature. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

In recent years, new improved chemistries and manufacturing processes have been developed that promise the development of lower cost and higher performance thermal batteries that could be produced in various shapes and sizes, including their small and miniaturized versions. However, the existing inertial igniters are relatively large and not suitable for small and low power thermal batteries, particularly those that are being developed for use in miniaturized fuzing, future smart munitions, and other similar applications. This is particularly the case for thermal batteries used in gun-fired munitions that are subjected to high G accelerations, sometimes 10,000-30,000 G and higher.

The need to differentiate accidental and initiation accelerations by the resulting impulse level of the event necessitates the employment of a safety system which is capable of allowing initiation of the igniter only during high total impulse levels. The safety mechanism can be thought of as a mechanical delay mechanism, after which a separate initiation system is actuated or released to provide ignition of the pyrotechnics. An inertial igniter that combines such a safety system with an impact based initiation system and its alternative embodiments are described herein together with alternative methods of initiation pyrotechnics.

Inertia-based igniters must therefore comprise two components so that together they provide the aforementioned mechanical safety (delay mechanism) and to provide the required striking action to achieve ignition of the pyrotechnic elements. The function of the safety system is to fix the striker in position until a specified acceleration time profile actuates the safety system and releases the striker, allowing it to accelerate toward its target under the influence of the remaining portion of the specified acceleration time profile. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

A schematic of a cross-section of a conventional thermal battery and inertial igniter assembly is shown in FIG. 1. In thermal battery applications, the inertial igniter 10 (as assembled in a housing) is generally positioned above (in the direction of the acceleration) the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total space that the thermal battery assembly 16 occupies within a munitions housing (usually determined by the total height 15 of the thermal battery), it is therefore important to reduce the height of the inertial igniter 10. This is particularly important for small thermal batteries since in such cases and with currently available inertial igniter, the height of the inertial igniter portion 13 is a significant portion of the thermal battery height 15.

It is, therefore, highly desirable to develop inertial igniters that are smaller in height and also preferably in volume for thermal batteries in general and for small thermal batteries in particular. This is particularly the case for inertia igniters for gun-fired munitions that experience high G firing setback accelerations levels, e.g., setback acceleration levels of 10-30,000 Gs or even higher, since such thermal batteries would have significantly higher no-fire and all-fire acceleration requirements, which should allow the development of inertial igniters that are smaller in height and possibly even in volume.

SUMMARY

A need therefore exists for novel mechanical inertial igniters for thermal batteries and the like for gun-fired munitions, mortars and the like that are subjected to high G setback accelerations during the launch, e.g., setback acceleration levels of 10-30,000 Gs or even higher. Such inertial igniters must be significantly smaller in height and preferably also significantly smaller in volume as compared to the currently available inertial igniters for thermal batteries and the like.

Such inertial igniters must be safe in general, and in particular should not initiate if dropped, for example, from up to 7 feet onto a concrete floor for certain applications; should not initiate when subjected to the specified no-fire acceleration levels; should be able to be designed to ignite at specified (all-fire) setback acceleration levels; should withstand high firing accelerations, for example up to 20-50,000 Gs, and do not cause damage to the thermal battery.

Reliability is also of great importance since in most munitions that use a thermal battery, the munitions relies on the battery to ensure its proper operation and prevent the munitions from becoming an unexploded ordinance. In addition, gun-fired munitions and mortars and the like are generally required to have a shelf life of up to 20 years and could generally be stored at temperatures of sometimes in the range of −65 to 165 degrees F. These requirements are usually satisfied best if the igniter pyrotechnic is in a hermetically sealed compartment or is inside the hermetically sealed thermal battery. The inertial igniters must also consider the manufacturing costs and simplicity in design to make them cost effective for munitions applications.

In addition, to ensure safety, inertial igniters should not initiate during acceleration events which may occur during manufacture, assembly, handling, transport, accidental drops, etc.

Those skilled in the art will appreciate that the inertial igniters disclosed herein provide the advantage of providing inertial igniters that are significantly shorter and generally smaller in volume than currently available inertial igniters for thermal batteries or the like, which is particularly important for small thermal batteries.

Accordingly, an inertial igniter for igniting a thermal battery upon a predetermined acceleration event is provided. The inertial igniter comprising: a base having a first projection; a striker mass rotatably connected to the base through a rotatable connection, the base having a second projection aligned with the first projection such that when the striker mass is rotated towards the base, the first projection impacts the second projection; and a rotation prevention mechanism for preventing impact of the first and second projections unless the predetermined acceleration event is experienced.

The rotation prevention mechanism can comprises a restriction member for restricting rotation of the sticker mass, the restriction member being disposed directly or indirectly between the striker mass and the base. The restriction member can have a weakened portion which fails upon the predetermined acceleration event thereby allowing the striker mass to rotate towards the base. The inertial igniter can further comprise a spring for biasing the striker mass in a biasing direction away from the base. The inertial igniter can further comprise a stop for limiting the movement of the striker mass in the biasing direction. The restriction member can be arranged in shear and the weakened portion can be a reduced cross-sectional portion. The restriction member can be arranged in tension and the weakened portion can be a reduced cross-sectional portion.

The rotation prevention mechanism can comprise a retaining member movably disposed at least partially in the striker mass and a blocking member movably disposed in a blocking position for blocking the retaining member from moving from the striker mass unless the predetermined acceleration event is experienced. The retaining member can be a ball disposed in a dimple on the striker mass. The blocking member can be a mass biased in the blocking position by a spring member. The blocking member can further have a curved surface for accommodating a portion of the retaining member. The blocking member cane be slidingly disposed relative to the base. The blocking member can be rotatably disposed relative to the base.

The rotation prevention mechanism can comprise a shearing member which is sheared by a force exerted by the striker mass upon the striker mass experiencing the predetermined acceleration event. The inertial igniter can further comprise a biasing member for biasing the shearing member away from a position in which the shearing member is sheared.

The rotation prevention mechanism can comprise a weakened portion which fails due to a force exerted by the striker mass upon the striker mass experiencing the predetermined acceleration event. The striker mass can have a first cam surface and the inertial igniter can further comprise a rotating member having a second cam surface in sliding contact with the first cam surface, the rotating member having a free end in communication with the weakened portion, wherein upon the striker mass experiencing the predetermined acceleration event, the first cam surface engages the second cam surface to force the free end into the weakened portion. The inertial igniter can further comprise a torsional spring element for biasing the free end of the rotating member away from the weakened portion.

One or more of the base and striker mass can include a pyrotechnic material which ignites upon the second projection striking the first projection.

The base can further include one or more openings for allowing a product of the ignited pyrotechnic to exit the opening.

The rotatable connection can include a pin disposed in at least a portion of the striker mass and base.

The rotatable connection can include a cylindrical portion on one of the striker mass and base and a corresponding cylindrical recess on the other of the striker mass and base.

Also provided is an inertial igniter for igniting a thermal battery upon a predetermined acceleration event. The inertial igniter comprising: a base having two or more first projections; two or more striker masses, each rotatably connected to the base through a rotatable connection, the base having two or more second projections aligned with the two or more first projections such that when the striker mass is rotated towards the base, each of the first projections impact a corresponding one of the two or more second projections; and a rotation prevention mechanism for preventing impact of each of the first projections with the corresponding second projections unless the predetermined acceleration event is experienced.

Still yet provided is a method for igniting a thermal battery upon a predetermined acceleration event. The method comprising: rotatably connecting a striker mass to a base; aligning a first projection on the striker mass with a second projection on the base such that when the striker mass is rotated towards the base, the first projection impacts the second projection; and preventing impact of the first and second projections unless the predetermined acceleration event is experienced.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

The safety related no-fire acceleration level requirements for inertial igniters that are used to initiate thermal batteries or other devices in gun-fired munitions, mortars or the like that are subjected to high-G setback (or impact) accelerations during the launch (or events such as target impact) are generally significantly higher than those that could occur accidentally, such as a result of the aforementioned drops from the 7 feet heights over concrete floors. In general, the no-fire safety requirement translates to the requirement of no initiation at acceleration levels of around 2000 Gs with a duration of approximately 0.5 msec. However, for initiation devices that are subjected to setback acceleration levels of 10-30,000 Gs or even higher, the no-fire acceleration levels are set at well above the 2000 G levels that munitions can experience when accidentally dropped over concrete floor from indicated heights of up to 7 feet. As a result, the no-fire acceleration levels for such munitions are set significantly higher than those that can be experienced during accidental drops.

In the following description and for the purpose of illustrating the methods of designing the disclosed inertial igniter embodiments to satisfy the prescribed no-fire and all-fire requirements of each munitions, a no-fire acceleration level of 3000 G (significantly higher than the accidental acceleration levels that may be actually experienced by the inertial igniter) and an all-fire acceleration level of 6000 G (significantly higher than the prescribed no-fire acceleration level of 3000 G) for a duration exceeding 2 msec will be used. It is, however, noted that as long as the prescribed no-fire acceleration level is significantly higher than those that may be actually experienced during accidental drops or the like and as long as the prescribed all-fire acceleration level is significantly higher than the prescribed no-fire acceleration level and its duration is long enough to cause the striker mass of the inertial igniter to gain enough energy to initiate the igniter pyrotechnic material, then the disclosed novel methods and various embodiments are useful to fabricate highly reliable and low cost inertial igniters for the munitions at hand. Here, two acceleration levels are considered to have a significant difference if considering the existing range of their distributions about the indicated values, their extreme values would still be a significant amount (e.g., at least 500-1000 G) apart.

Figure 1:
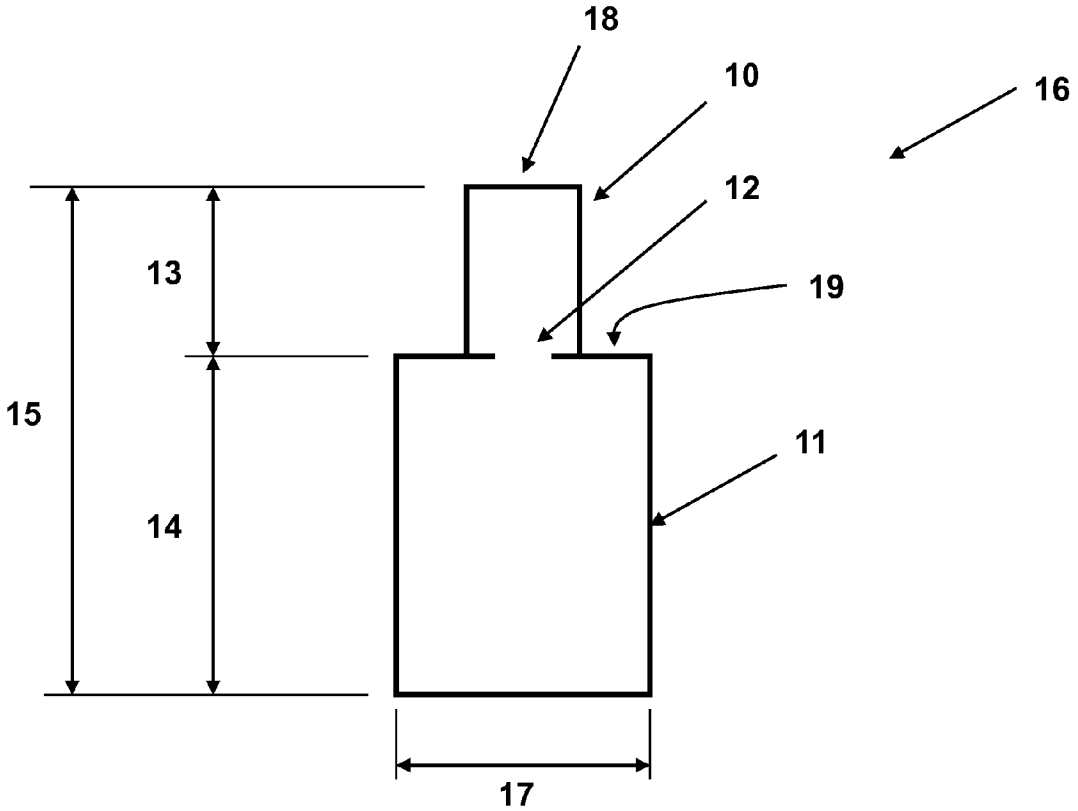
Figure 1 (PRIOR ART)
FIG. 1 illustrates a schematic of a cross-section of a thermal battery and inertial igniter assembly of the prior art.
Figure 2:
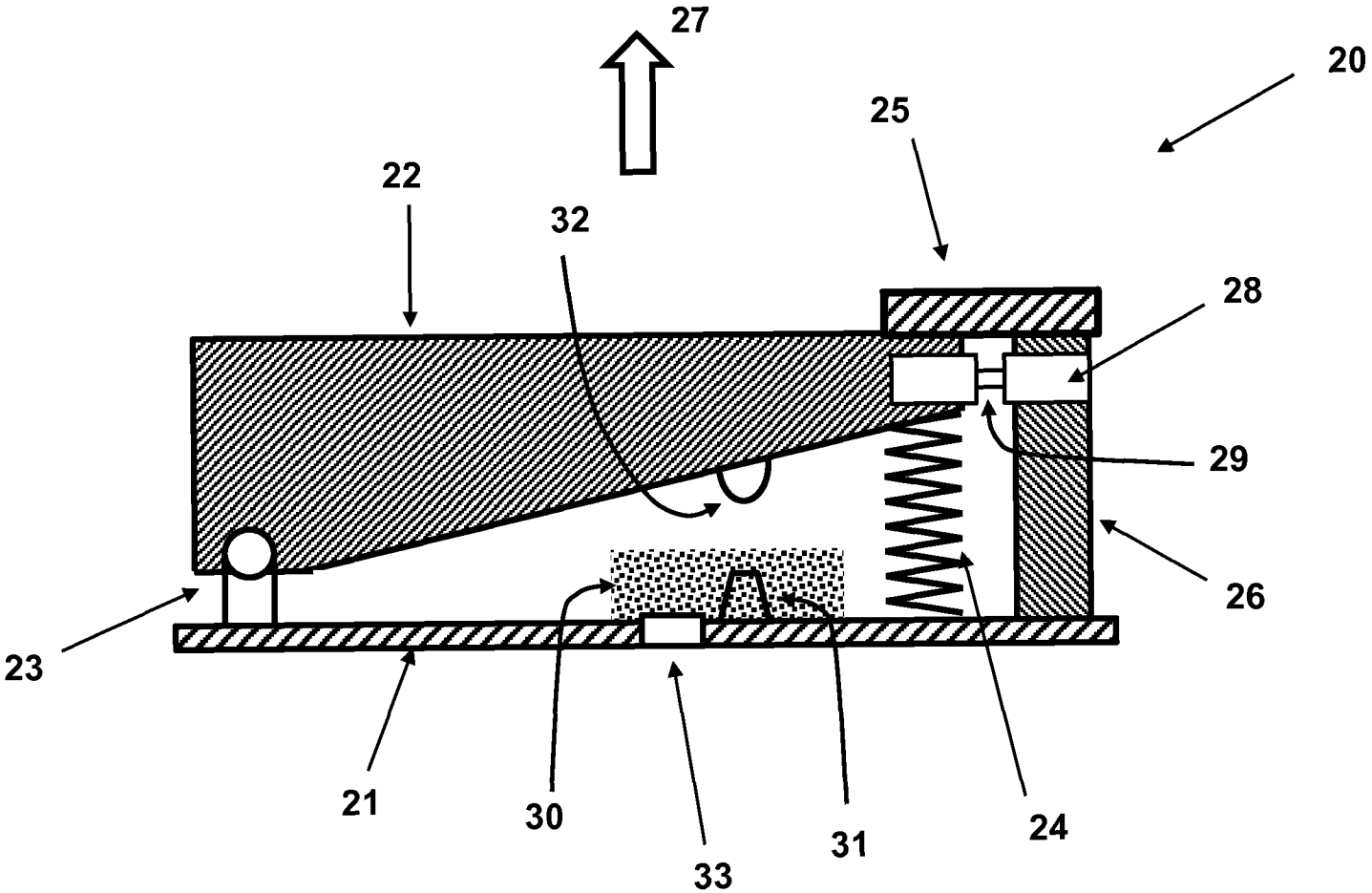
FIG. 2 illustrates a schematic of a cross-section of a first inertial igniter embodiment.

A schematic of a cross-first embodiment 20 is shown in FIG. 2. The inertial igniter 20 is considered to be cylindrical in shape since most thermal batteries are constructed in cylindrical shapes, but may be constructed in any other shape with the general cross-sectional view shown in FIG. 2 and with its general mode of operation. The inertial igniter 20 consists of a base element 21 (which can be separate from or integral with the thermal battery), which in a thermal battery construction shown in FIG. 1 would be positioned in the housing 10 with the base element 21 positioned on the top of the thermal battery cap 19. A striker mass 22 of the inertial igniter is attached to the base element 21 via a rotary joint 23. In the embodiment 20 of FIG. 2, the striker mass 22 is kept separated from the base element 21 by a spring element 24 which biases the striker mass 22 away from the base element 21. A stop element 25 is also provided to limit the counterclockwise rotation of the striker mass 22 relative to the base element 21 (the stop element opposes the biasing of the striker mass 22 due to the spring element 24). The stop element 25 is attached a post 26, which is in turn attached to the base element 21 of the inertial igniter 20.

The spring element 24 can be preloaded in compression such that with the no-fire acceleration acting on the base element 21 of the inertial igniter in the upward direction, as shown by the arrow 27, the inertia force due to the mass of the striker mass 22 would not overcome (or at most be equal to) the preloading force of the spring element 24. As a result, the inertial igniter 20 is ensured to satisfy its prescribed no-fire requirement.

A shearing pin 28 is also provided and is fixed to the post 26 on one end and to a portion, such as an end of the striker mass 21 on the other end as shown in FIG. 2. The shearing pin 28 is provided with a narrow neck 29, which provides for concentrated stress when the striker mass 22 is pressed down towards the base element 21 due to all-fire acceleration in the direction of the arrow 27 acting on the inertia of the striker mass 22. By properly designing the geometry of the shearing pin 28 and its neck 29 and selection of the proper material for the shearing pin 28, the shearing pin 28 can be designed to fracture in shear (and in fact in any other mode as described later in this disclosure), thereby releasing the striker mass 22 and allowing it to be accelerated in the clockwise rotation. The free end of the striker mass 22 is sized, shaped and otherwise configured so as not to interfere with any other portions, such as the post 26 when turning about the pivot 23 upon the all As a result, for a properly designed inertial igniter 20 (i.e., by selecting a proper mass and moment of inertial for the striker mass 22, the required range of clockwise rotation for the striker mass 22 so that it would gain enough energy, considering the all-fire acceleration level and the preloading level of the spring element 24), the striker mass 22 will gain enough energy to initiate the pyrotechnic material 30 between the pinching points provided by the protrusions 31 and 32 on the base element 21 and the bottom surface of the striker mass 22, respectively, as shown in the schematic of FIG. 2. The ignition flame and sparks can then travel down through the opening 33 provided in the base element 21. When assembled in a thermal battery similar to the thermal battery 16 of FIG. 1, the inertial igniter is mounted in the housing 10 such that the opening 33 is lined up with the opening 12 into the thermal battery 11 to activate the battery by igniting its heat pallets.

It is will be appreciated by those skilled in the art that the duration of the all-fire acceleration level is also important for the proper operation of the inertial igniter 20 by ensuring that the all-fire acceleration level is available long enough to accelerate the striker mass 22 towards the base element 21 to gain enough energy to initiate the pyrotechnic material 30 as described above by the pinching action between the protruding elements 31 and 32.

It is will be appreciated by those skilled in the art that when the inertial igniter 20 (FIG. 2) is assembled inside the housing 10 of the thermal battery assembly 16 of FIG. 1, a cap 18 (or a separate internal cap—not shown) is commonly used to secure the inertial igniter 20 inside the housing 10. In such assemblies, the stop element 25 is no longer functionally necessary since the striker mass 22 is prevented by the said cap from tending to rotate in the counterclockwise direction by the spring element 24, thereby minimizing the shearing load on the shearing pin in the assembled thermal battery. It is, however, appreciated by those skilled in the art that by proving the stop element 25, the storage of the inertial igniter 20 and the process of assembling it into the housing 10 is significantly simplified since one does not have to provide secondary means to keep the spring element 24 from applying shearing load to the shearing pin 28.

It will be appreciated by those skilled in the art that in place of the shearing pin 28, other types of elements that are designed to fracture upon the application of the all-firing acceleration as described above and release the striker mass 22 may be used to perform the same function. For example, the mode of fracture may be selected to be in tension, torsion or pure bending. In general, the fracture can be achieved with minimal deformation in the direction that results in a significant clockwise rotation of the striker mass 22 prior to pin fracture and release of the striker mass 22. This would result in minimum height requirement for the inertial igniter since the clockwise rotation of the striker mass 22 will reduce the terminal (clockwise) rotational speed of the striker mass 22 at the instant of initiation impact between the protruding elements 31 and 32, FIG. 2, and pinching of the pyrotechnic material 30 to achieve initiation.

Figure 3:
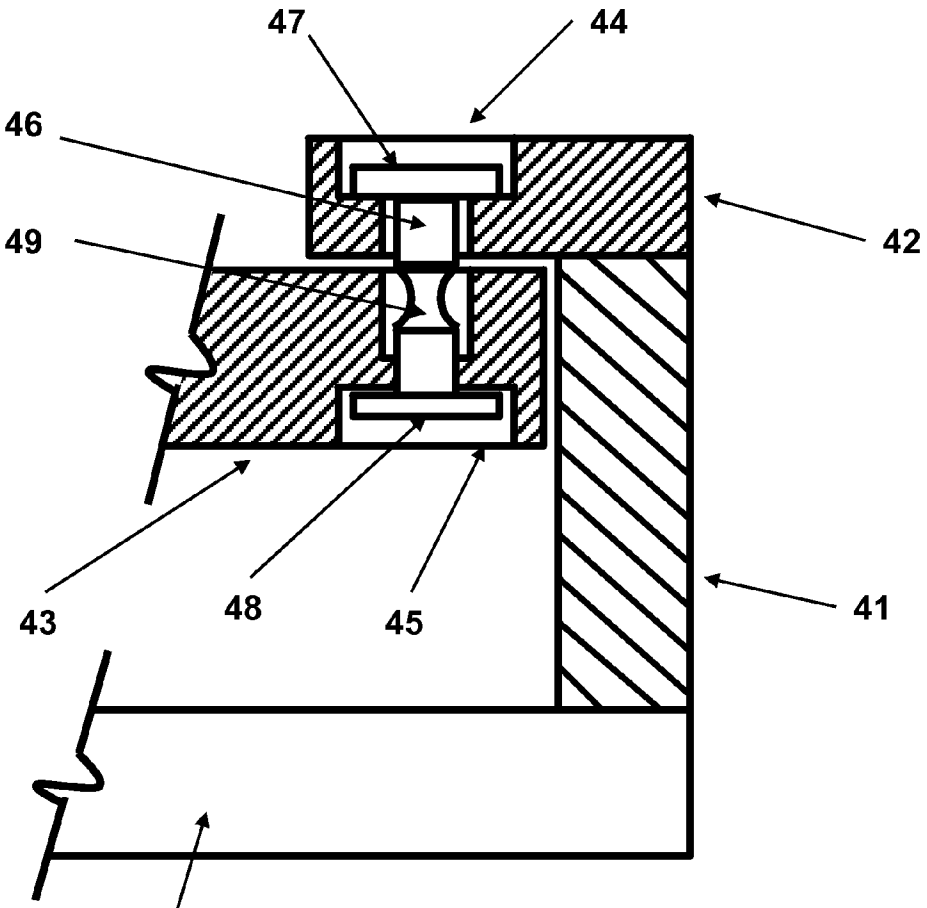
FIG. 3 illustrates a schematic of the cross-section of the tensile-mode failure element of a second inertial igniter embodiment.

As an example, the option of replacing the shearing pin 28, FIG. 2, with a pin that is designed to fracture in tension by when the inertial igniter 20 is subjected to the aforementioned all-fire acceleration is shown in the schematic of FIG. 3. Part of the base element 40, the post 41, the stop element 42 and the front portion of the striker mass 43 (indicated by numerals 21, 26, 25 and 22 in FIG. 2, respectively) are shown. The stop element 42 is provided with a hole and countersink 44 as shown in FIG. 3. An opposite hole and countersink 45 is provided in the striker mass 43 under the stop element 42 as shown in FIG. 3. A one piece tension element 46 (which can be cylindrical in shape) with top and bottom flange portions 47 and 48, respectively, is also provided. The top flange portion 47 of the tension element 46 is assembled seating in the countersink 44 of the stop element 42 and the bottom flange portion 48 of the tension element 46 is assembled seating in the countersink 45 of the striker mass 43. The stop element 42 and the striker mass 43 can be provided with passages (not shown) for assembling the tension element 46 as shown in FIG. 3. Alternatively, the tension element 46 may be a two part element that is assembled in place as shown in FIG. 3, such as by riveting, welding or otherwise fastening the flange 47 to the stem portion of the tension element 46. The tension element 46 is also provided with a narrow neck portion 49, which provides for concentrated stress when the striker mass 43 is pressed down towards the base element 40 due to all-fire acceleration in the direction of the arrow 27 (FIG. 2) acting on the inertia of the striker mass 43. By properly designing the geometry of the tension element 46 and its neck portion 49 and selection of the proper material, the tension element 46 can be designed to fracture in tension, thereby releasing the striker mass 43 and allowing it to be accelerated in the clockwise rotation. As a result, for a properly designed inertial igniter (i.e., by selecting a proper mass and moment of inertial for the striker mass 43, the required range of counterclockwise rotation for the striker mass 43 so that it would gain enough energy, considering the all-fire acceleration level and the preloading level of the spring element 24, the striker mass 43 will gain enough energy to initiate the pyrotechnic material 30 between the pinching points provided by the protrusions 31 and 32 on the base element 40 and the bottom surface of the striker mass 43, respectively, as shown in the schematics of FIGS. 2 and 3. The ignition flame and sparks can then travel down through the opening 33 provided in the base element 40. When assembled in a thermal battery similar to the thermal battery 16 of FIG. 1, the inertial igniter is mounted in the housing 10 such that the opening 33 is lined up with the opening 12 into the thermal battery 11 to activate the battery by igniting its heat pallets.

The shearing pin can be a failure member of any configuration having a portion that is weaker than other portions about which the failure member can fail upon experiencing the all-fire acceleration level. Such weaker portion can include a material that has one or more portions having a smaller cross-sectional area than other portions and/or different materials having a weaker strength than other portions as is known in the art.

Figure 4:
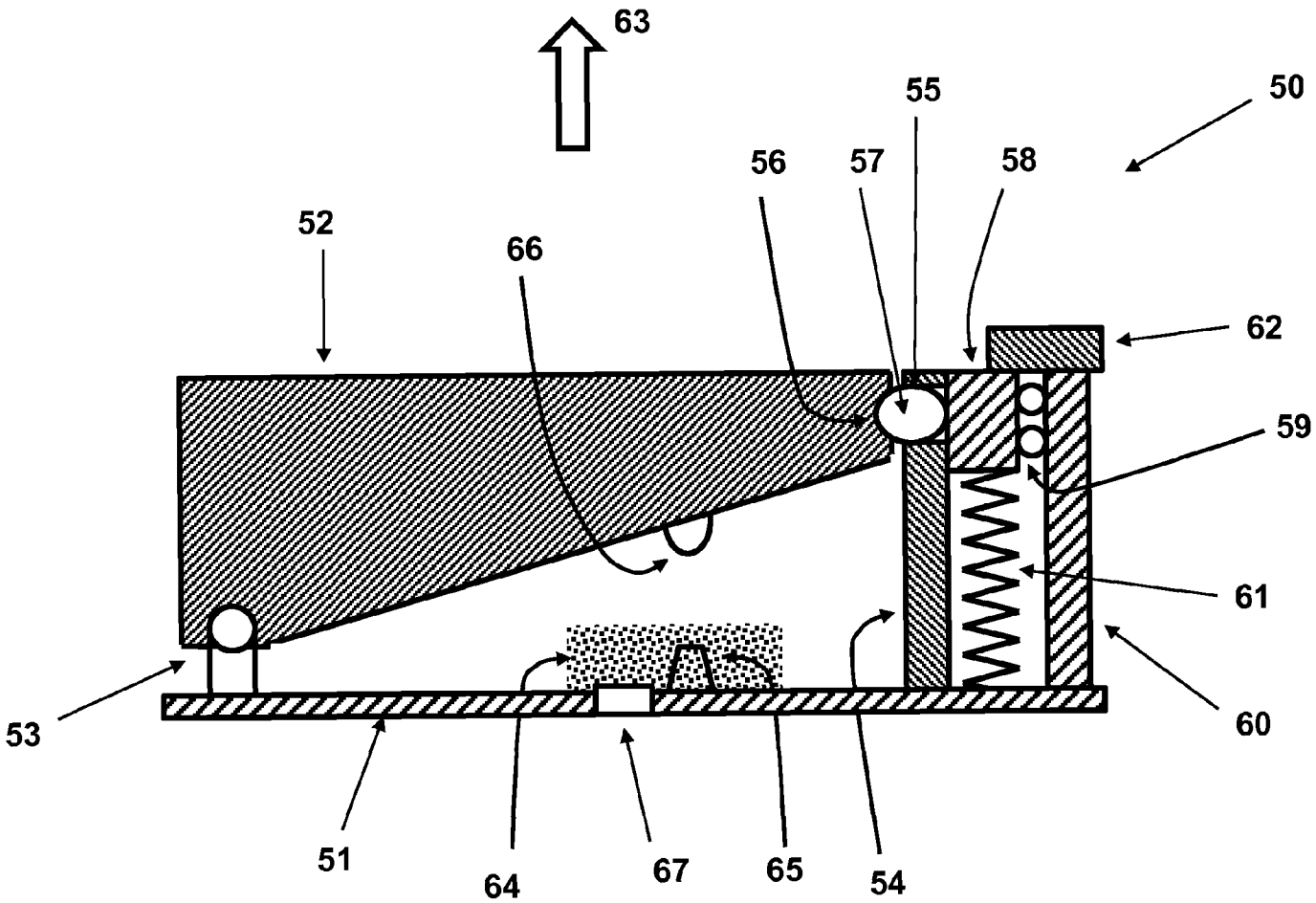
FIG. 4 illustrates a schematic of a cross-section of another inertial igniter embodiment.

Another embodiment 50 is illustrated schematically in FIG. 4. Similar to the inertial igniter of embodiment 20 of FIGS. 2 and 3, the inertial igniter 50 consists of a base element 51, which in a thermal battery construction shown in FIG. 1 would be positioned in the housing 10 with the base element 51 positioned on the top of the thermal battery cap 19. The striker mass 52 of the inertial igniter 50 is attached to the base element 51 via the rotary joint 53. A post 54, which is fixed to the base element 51 is provided with a hole 55, which in the configuration shown in FIG. 4 is aligned with a dimple 56 in the striker mass 52. A ball 57 is positioned in the hole 55, extending into the dimple 56 of the striker mass 52. In the configuration of FIG. 4, the (up-down) sliding member 58 is shown to block the movement of the ball 57 out of engagement with the dimple 56 of the striker mass 52, thereby locking the striker mass 52 in the illustrated configuration. A sliding member 58 is free to slide down against a member 60 (the rolling elements 59 are provided for illustrative purposes only to indicate a sliding joint between the sliding member 58 and the surface of the member 60). The member 60 is fixed to the base element 51. A spring element 61 resists downward motion of the sliding member 58, and is preferably preloaded in compression so that if a downward force that is less than the compressive preload is applied to the sliding member 58, the applied force would not cause the sliding element 58 to move downwards. A stop 62, fixed to the member 60, is provided to allow the spring element 61 to be preloaded in compression by preventing the sliding member 58 from moving further up from the configuration shown in FIG. 4.

During the firing, the inertial igniter 50 is considered to be subjected to setback acceleration in the direction of the arrow 63. If a level of acceleration in the direction of the arrow 63 acts on the inertia of the sliding element 58, it would generate a downward force that tends to slide the sliding element 58 downwards (opposite to the direction of acceleration). The compression preloading of the spring element 61 is selected such that with the no-fire acceleration levels, the inertia force acting on the sliding element 58 would not overcome (or at most be equal to) the preloading force of the spring element 61. As a result, the inertial igniter 50 is ensured to satisfy its prescribed no-fire requirement.

Now if the acceleration level in the direction of the arrow 63 is high enough, then the aforementioned inertia force acting on the sliding element 58 will overcome the preloading force of the spring element 61, and will begin to travel downward. If the acceleration level is applied over a long enough period of time (duration) as well, i.e., if the all-fire condition is satisfied and the sliding element 58 will have enough time to travel down far enough to allow the ball 57 to be pushed out of the dimple 56, thereby releasing the striker mass 52 and allowing it to be accelerated in the clockwise rotation. As a result, for a properly designed inertial igniter 50 (i.e., by selecting a proper mass and moment of inertial for the striker mass 52 and the range of clockwise rotation for the striker mass 52 so that it would gain enough energy), the striker mass 52 will gain enough energy to initiate the pyrotechnic material 64 between the pinching points provided by the protrusions 65 and 66 on the base element 51 and the bottom surface of the striker mass 52, respectively, as shown in the schematic of FIG. 4. The ignition flame and sparks can then travel down through the opening 67 provided in the base element 51. When assembled in a thermal battery similar to the thermal battery 16 of FIG. 1, the inertial igniter is mounted in the housing 10 such that the opening 67 is lined up with the opening 12 into the thermal battery 11 to activate the battery by igniting its heat pallets.

It will be appreciated by those skilled in the art that the duration of the all-fire acceleration level can also be important for the operation of the inertial igniter 50 by ensuring that the all-fire acceleration level is available long enough to accelerate the striker mass 52 towards the base element 51 to gain enough energy to initiate the pyrotechnic material 30 as described above by the pinching action between the protruding elements 65 and 66.

It will be appreciated by those skilled in the art that when the inertial igniter 50 (FIG. 4) is assembled inside the housing 10 of the thermal battery assembly 16 of FIG. 1, a cap 18 (or a separate internal cap—not shown) is commonly used to secure the inertial igniter 50 inside the housing 10. In such assemblies, the stop element 62 is no longer functionally necessary since the sliding element 58 is prevented from being pushed upward by the force of the spring element 61 and releasing the striker mass 52. It will be, however, appreciated by those skilled in the art that by providing the stop element 62, the storage of the inertial igniter 50 and the process of assembling it into the housing 10 is significantly simplified since one does not have to provide secondary means to keep the spring element 61 from pushing the sliding element 58 further up and passed the locking ball 57 and releasing the striker mass 52.

In the embodiment of FIG. 4, the sliding and spring elements of the locking ball release mechanism may be configured in numerous ways, e.g., the sliding element 58 may be replaced with a rotating member (which may reduce the possibility of jamming) and the spring member 61 may be combined with the rotating member, i.e., as flexible beam element with the inertia of the beam acting as the mass element of the slider.

An advantage of the embodiment of FIG. 4 over those of FIGS. 2 and 3 is that the amount of force to shear the pin or break in tension may not be reliably estimated, on the other hand, the amount and duration of acceleration to move the sliding element 58 in FIG. 4 is more predictable.

The sliding element may also be provided with a cup-like base under the ball (with the ball sticking out into the sliding element and over the lip of the cup) so that a top piece is not needed to prevent the preloaded spring to push the sliding element out (up) (see e.g., U.S. application Ser. No. 12/835,709 filed on Jul. 13, 2010, the contents of which is incorporated herein by reference).

The rotary hinge 23 (53) used to attach the striker mass 22(52) to the base element 21(51) of the inertial igniter does not have to be constructed with a pin passing through the connected rotating parts as shown in FIG. 2(4). It may, for example, be constructed with a living joint. Alternatively, the joint may also be constructed with one side (for example the striker mass side) formed as a rolling surface with mating surfaces on the base element surface (FIG. 5); or with an intermediate roller or balls with preloaded springs keeping them in contact (FIG. 6); or other similar methods known in the art.

Figure 5:
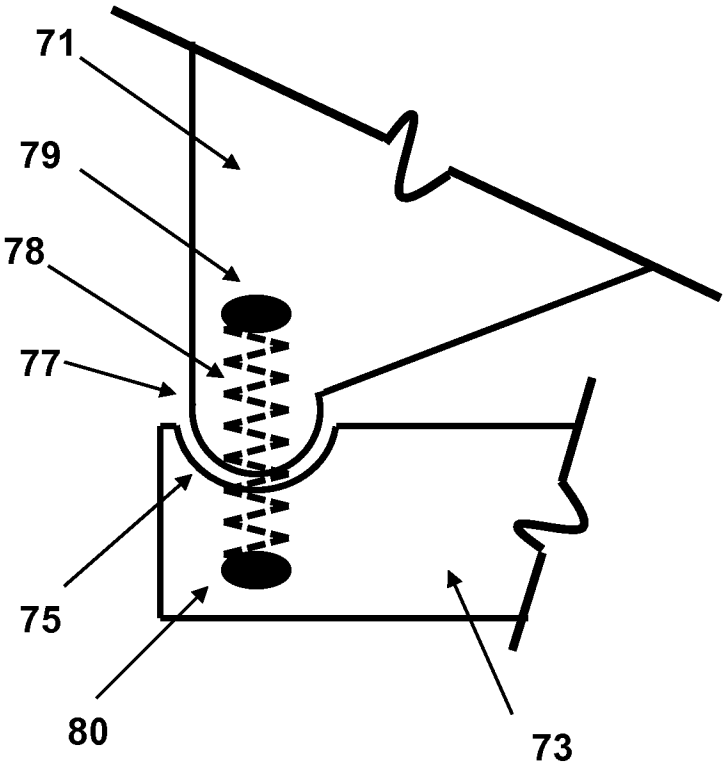
FIG. 5 illustrates a schematic of an alternative rotary joint for the inertial igniter embodiment of FIG. 4.

In the rotary joint shown in FIG. 5, the rotary joint is between the striker mass 71 and the base element 73. The base element 73 is provided with a preferably half-cylindrical recess 75. The striker mass 71 is provided with a matching cylindrical base 77, which allows the striker mass 71 to rotate relative to the base element 73. The spring element 78, which is attached to the striker mass 71 at point 79 on one end and to the base element 73 at point 80 on the other end, is preloaded in tension to keep the striker mass 71 and the base element 73 in continuous contact.

Figure 6:
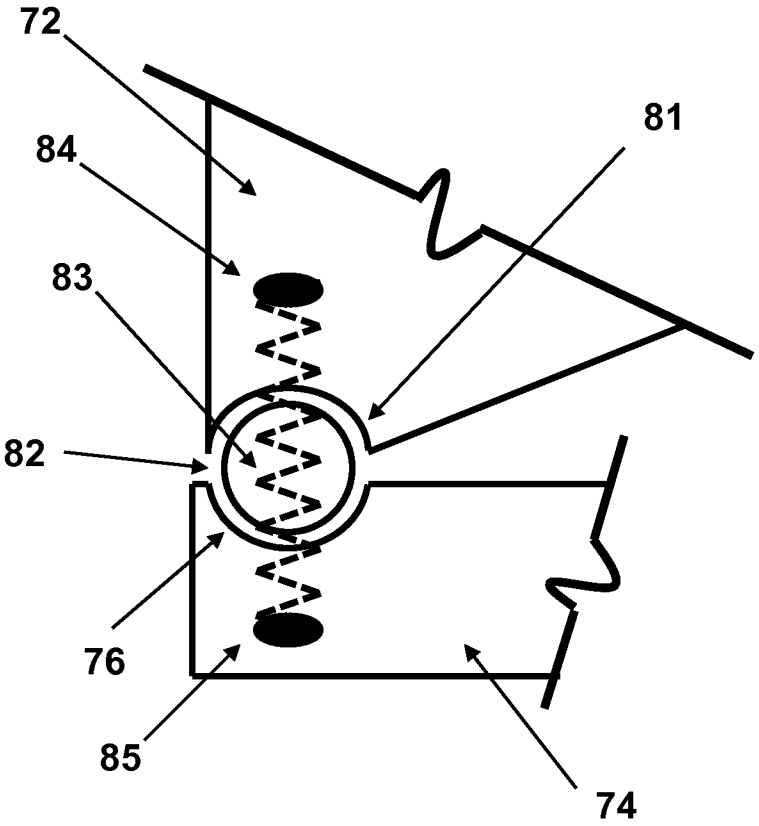
FIG. 6 illustrates a schematic of another alternative rotary joint for the inertial igniter embodiment of FIG. 4.

In the rotary joint shown in FIG. 6, the rotary joint is between the striker mass 72 and the base element 74. The base element 74 is provided with a half-cylindrical recess 76. The striker mass 72 is provided with a matching cylindrical recess 81, with the roller or balls 82 disposed in the recesses 76 and 81 to form a rotary joint between the striker mass 72 and the base element 74. Similar to the rotary joint of FIG. 5, a spring element 83, which is attached to the striker mass 72 at point 84 on one end and to the base element 74 at point 85 on the other end, is preloaded in tension to keep the striker mass 72 and the base element 74 in continuous contact.

Figure 8:
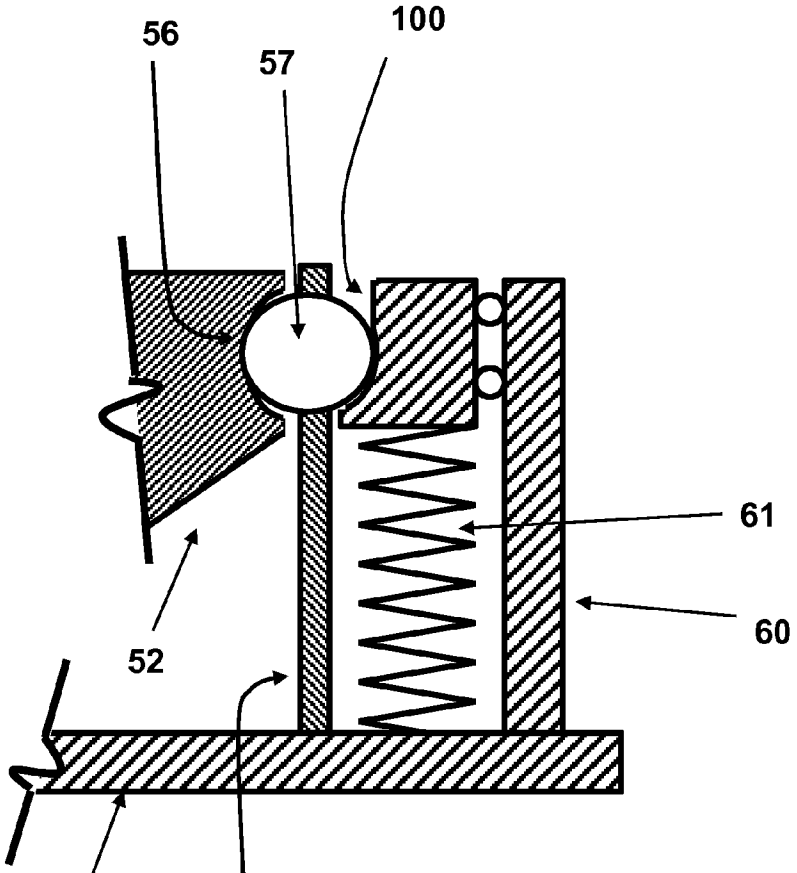
FIG. 8 illustrates a schematic of a partial cross-section of a variation of the embodiment of FIG. 4.

It was noted that the embodiment 50 of FIG. 4 requires the stop element 62 to prevent further upward motion of the sliding element 58 by the force of the compressively loaded spring element 61. In an alternative design of this portion of the inertial igniter 50 shown in FIG. 8, the sliding element is provided with a recessed surface 100 that in the configuration of the inertial igniter 50 shown in FIG. 4 is pushed against the lower surface of the locking ball 57 as shown in the schematic of FIG. 8 by the compressively loaded spring element 61. As a result, the sliding element 58 is prevented from further upward motion.

It is appreciated by those skilled in the art that in the embodiment 50 of FIG. 4 the locking ball 57 release mechanism (consisting of sliding element 58 and the spring element 61) could be replaced with many other types of mechanisms. One such release mechanism embodiment is shown in the schematic of FIG. 7.

Figure 7:
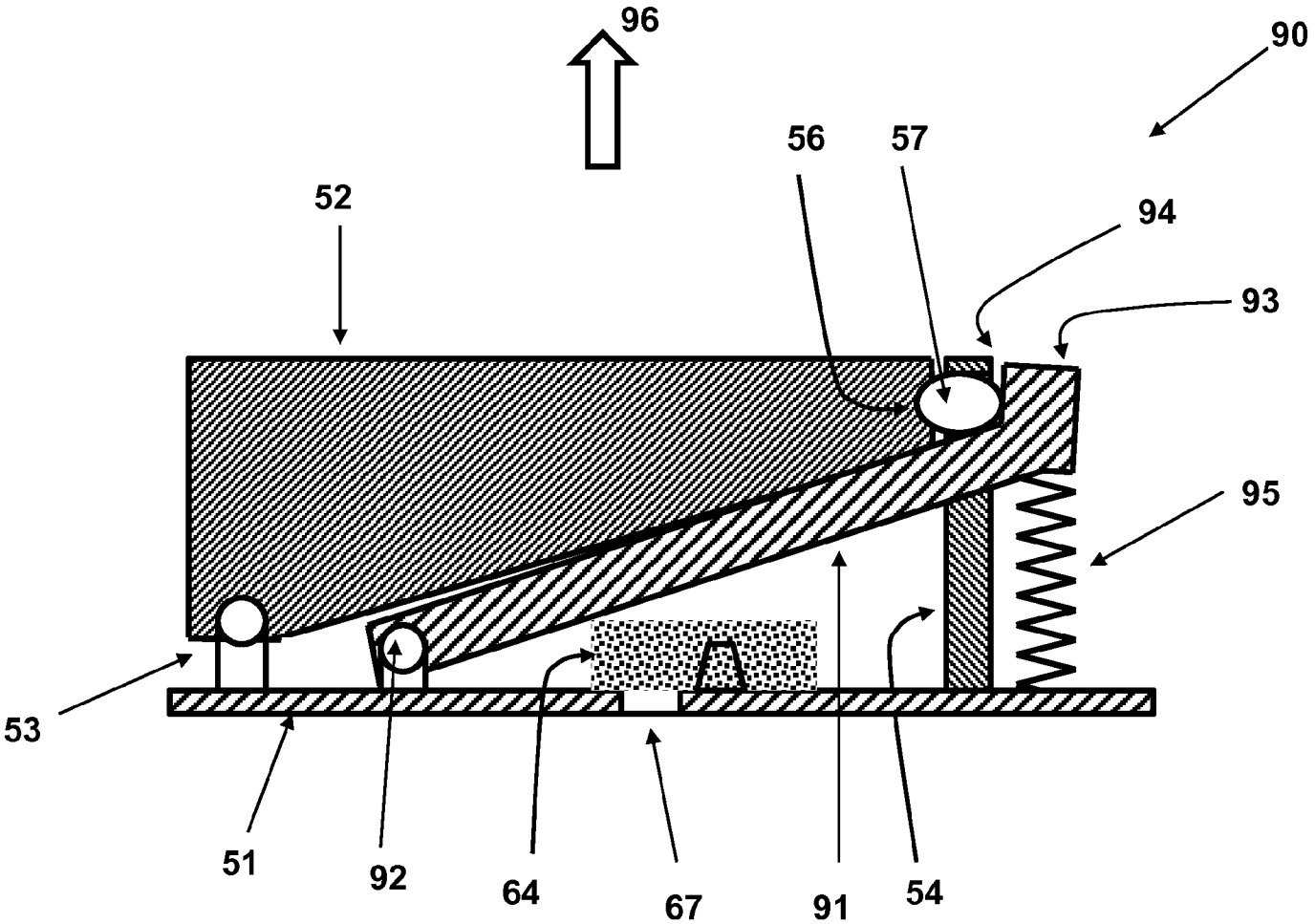
FIG. 7 illustrates a schematic of a cross-section of yet another preferred inertial igniter embodiment.

In the embodiment of FIG. 7, the components of the inertial igniter 90 are identical to those of the embodiment 50 of FIG. 4 except the locking ball 57 release mechanism components (the sliding element 58 and its related elements 59-62), which are all replaced by the components of the present embodiment. In this embodiment 90 of the inertial igniter, a lever element 91, attached to the base element 51 by a rotary joint 92 is provided as shown in FIG. 7. The rotary joint 92 can be the same or a different rotary joint from rotary joint 53. On the free end of the lever element 91 is provided with an end 93 with the geometry that provides a surface, such as a planar surface 94 facing the locking ball 57. In normal conditions, the lever element 91 is held in the configuration shown in FIG. 7, i.e., with the flat surface 94 facing the locking ball 57, thereby locking the striker mass 52 to the post 54 (i.e., the base element 51). A spring element 95, which is preloaded in compression, is used to keep the lever element 91 in the configuration of FIG. 7. It is noted that in this embodiment, there is no need for the stop element 62 shown in FIG. 4 since the compressively preloaded spring element 95 pushed the surface 94 against the surface of the post 54, thereby preventing the lever element 91 to rotate any further in the counterclockwise direction to and release the locking ball.

During the firing, the inertial igniter 90 is considered to be subjected to setback acceleration in the direction of the arrow 96. Acceleration in the direction of the arrow 96 will act on the inertia of the inertia of the lever element 91, and generate a downward force that would tend to rotate the lever element 91 in the clockwise direction. The compression preloading of the spring element 95 will, however, resists the clockwise rotation of the lever element 91. The level of compressive preloading of the spring element 95 is selected such that with the no-fire acceleration levels, the inertia force acting on the lever element 91 would not overcome the preloading force of the spring element 95. As a result, the inertial igniter 90 is ensured to satisfy its prescribed no-fire requirement.

Now if the acceleration level in the direction of the arrow 96 is high enough, then the aforementioned inertia force acting on the lever element 91 will overcome the preloading force of the spring element 95, and will begin rotate in the clockwise direction. Now if the acceleration level is applied over a long enough period of time as well, i.e., if the all-fire condition is satisfied, then the lever element 91 will have enough time to rotate enough in the clockwise direction to allow the locking ball 57 to be pushed out of the dimple 56, thereby releasing the striker mass 52 and allowing it to be accelerated in the clockwise rotation. As a result, for a properly designed inertial igniter 90 (i.e., by selecting a proper mass and moment of inertial for the striker mass 52 and range of clockwise rotation for the striker mass 52 so that it would gain enough energy), the striker mass 52 will gain enough energy to initiate the pyrotechnic material 64 between the pinching points provided by the protrusions 65 and 66 on the base element 51 and the bottom surface of the striker mass 52, respectively, as shown in the schematic of FIG. 4. The ignition flame and sparks can then travel down through the opening 67 provided in the base element 51. When assembled in a thermal battery similar to the thermal battery 16 of FIG. 1, the inertial igniter is mounted in the housing 10 such that the opening 67 is lined up with the opening 12 into the thermal battery 11 to activate the battery by igniting its heat pallets.

It is appreciated by those skilled in the art that the duration of the all-fire acceleration level is also important for the proper operation of the inertial igniter 50 by ensuring that the all-fire acceleration level is available long enough to accelerate the striker mass 52 towards the base element 51 to gain enough energy to initiate the pyrotechnic material 30 as described above by the pinching action between the protruding elements 65 and 66.

Figure 9:
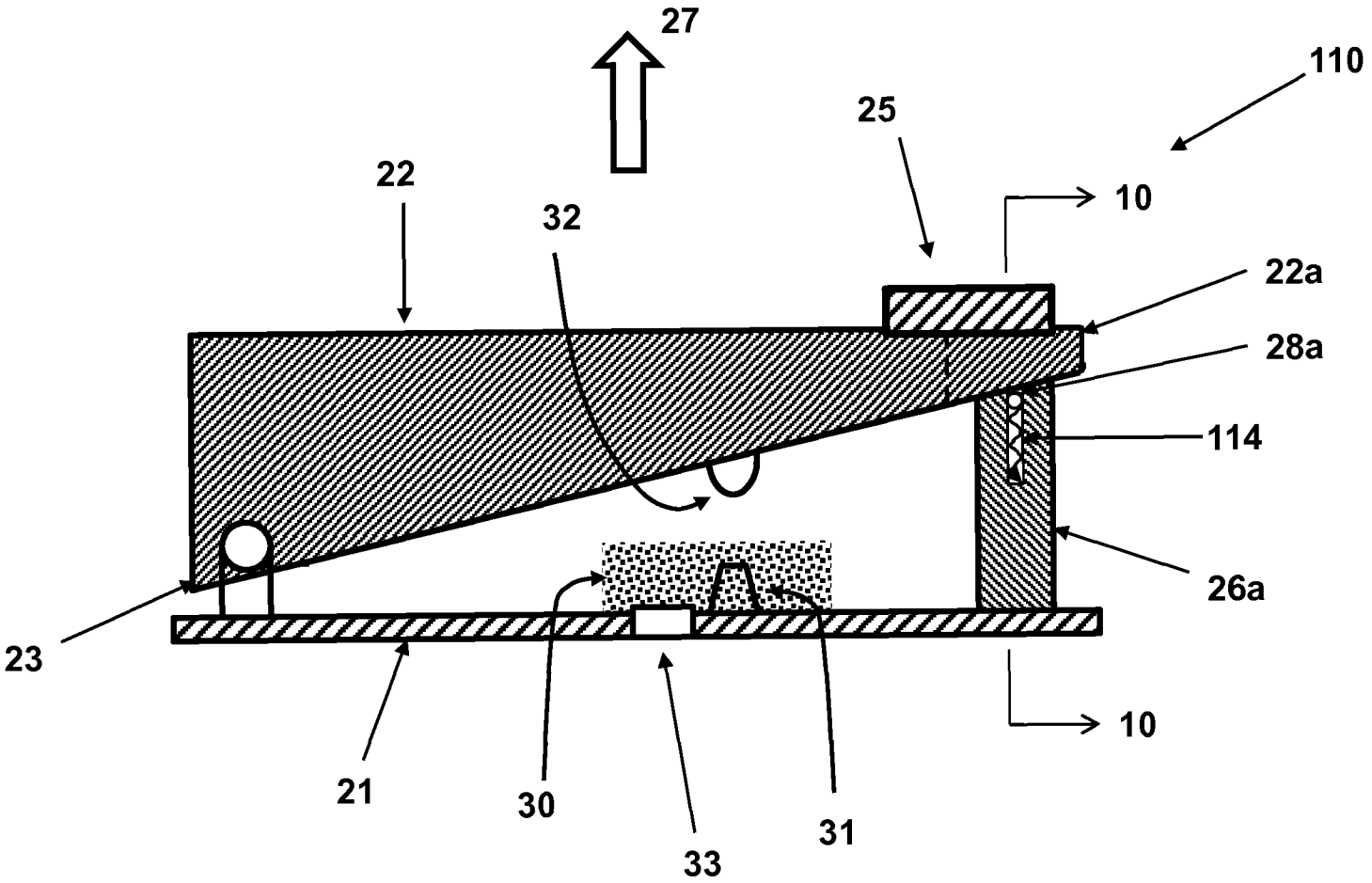
FIG. 9 illustrates a schematic of a cross-section of a still yet another inertial igniter embodiment.
Figure 10:
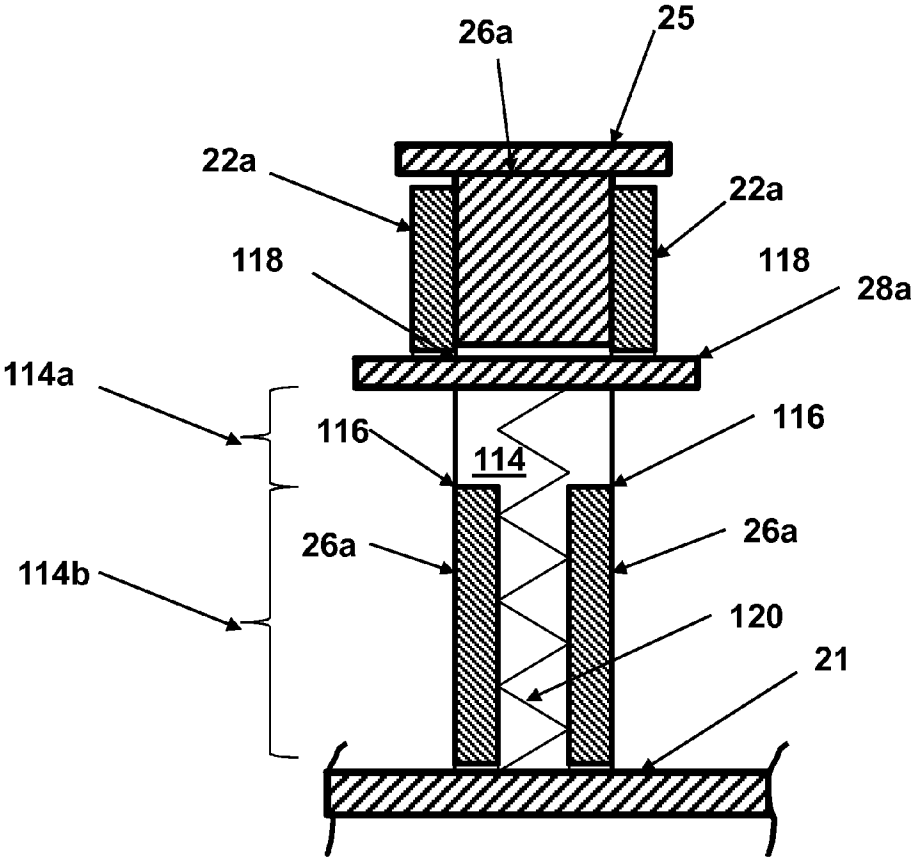
FIG. 10 illustrates a schematic of a partial cross-section taken along line 10-10 of FIG. 9.

Referring now to FIG. 9, there is shown another embodiment of an inertial igniter, referred to generally by reference numeral 110 in which similar elements are referred to with similar reference numerals from previous embodiments. In the inertial igniter 110 of FIG. 9, the striker mass 22 has projections 22*a* extending around and past a post 26*a* (in the direction towards the post). The post, referring also to the cross-section of FIG. 10, includes an elongated slot 114. The slot 114 is open on opposite sides of the post 26*a* for at least a portion (114*a*) of a length of the slot and closed in another portion (114*b*). A shearing pin 28*a* is slidingly disposed in the open portion 114*a* of the slot 114 with the ends thereof extending past the sides of the slot and can further extend past the periphery of the projections 22*a* of the striker mass 22, as shown in FIG. 10. A spring 120 is disposed in the slot 114 to bias the shearing pin 28*a* against the projections 22*a* of the striker mass 22 in the direction of the acceleration 27.

During the firing, the inertial igniter 110 is considered to be subjected to setback acceleration in the direction of the arrow 27. Acceleration in the direction of the arrow 27 will act on the inertia of the striker mass 22, and generate a downward force that would tend to rotate the same in the clockwise direction and press the shearing pin 28*a* against the biasing force of the spring 120. A compressive preloading of the spring 120 will, however, resist the clockwise rotation of the striker mass 22. The level of compressive preloading of the spring 120 is selected such that with the no-fire acceleration levels, the inertia force acting on the shearing pin 28*a* would not overcome the preloading force of the spring 120 and/or the force necessary to shear the shearing pin 28*a*. As a result, the inertial igniter 110 is ensured to satisfy its prescribed no-fire requirement.

When the striker mass 22 is pressed down towards the base element 21 due to all-fire acceleration in the direction of the arrow 27 acting on the inertia of the striker mass 22. The striker mass projections 22*a* press on the shearing pin 28*a* (against the biasing force of the spring 120) to shear the same. In this regard, edges 116 of the post 26*a* and/or edges 118 of the projections 22*a* can be configured to facilitate shearing of the shearing pin 28*a*, such as providing a sharp edge. Once the shearing pin 28*a* is sheared, the striker mass 22 is released and allowed to accelerate in the clockwise rotation. As a result, for a properly designed inertial igniter (i.e., by selecting a proper mass and moment of inertial for the striker mass 22), the required range of counterclockwise rotation for the striker mass 22 so that it would gain enough energy, considering the all-fire acceleration level and the preloading level of the spring element 120, the striker mass 22 will gain enough energy to initiate the pyrotechnic material 30 between the pinching points provided by the protrusions 31 and 32 on the base element 21 and the bottom surface of the striker mass 22. The ignition flame and sparks can then travel down through the opening 33 provided in the base element 21. When assembled in a thermal battery similar to the thermal battery 16 of FIG. 1, the inertial igniter is mounted in the housing 10 such that the opening 33 is lined up with the opening 12 into the thermal battery 11 to activate the battery by igniting its heat pallets.

Figure 11:
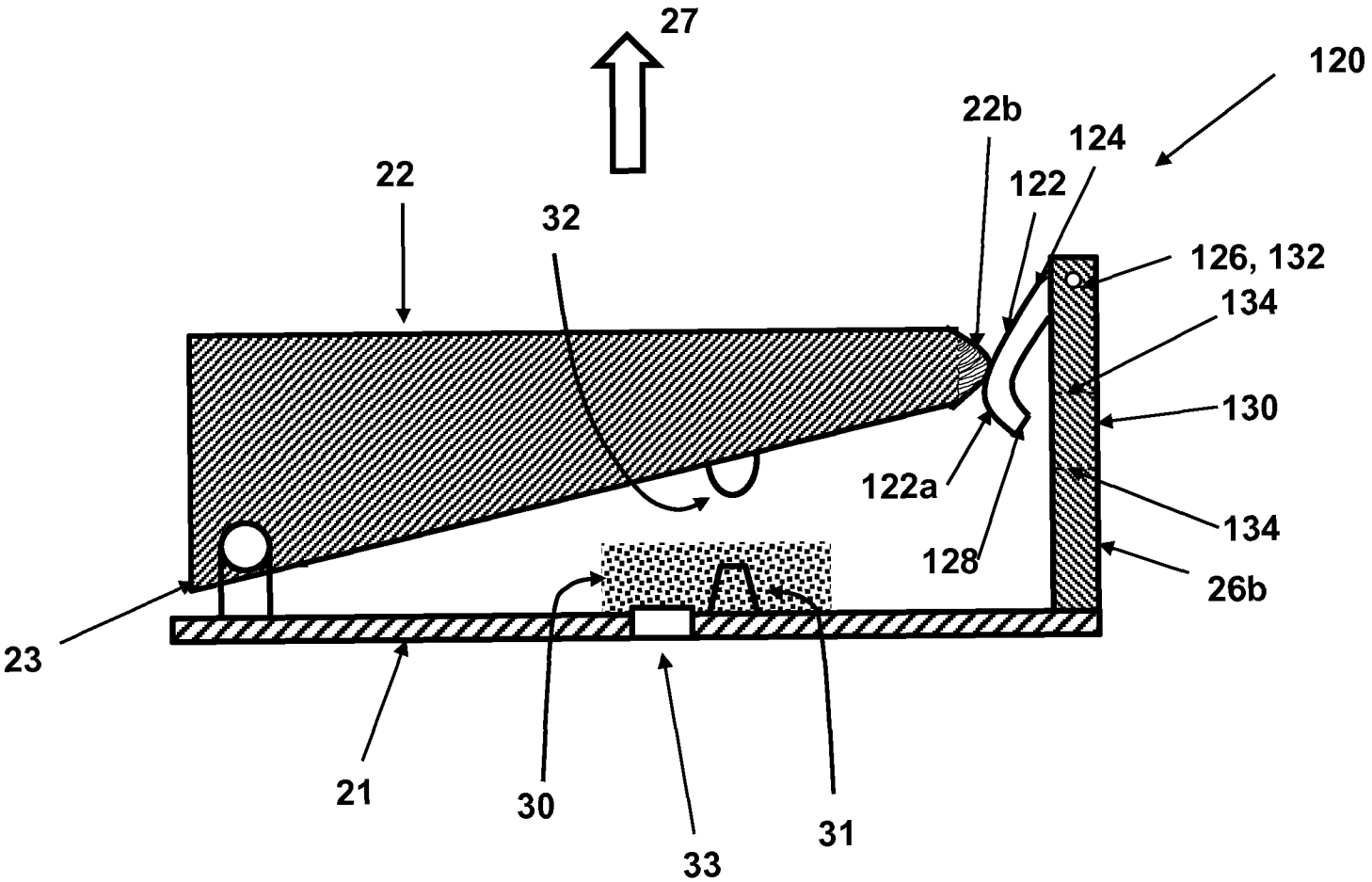
FIG. 11 illustrates a schematic of a cross-section of a still yet another inertial igniter embodiment.

Referring now to FIG. 11, there is shown another embodiment of an inertial igniter, referred to generally by reference numeral 120 in which similar elements are referred to with similar reference numerals from previous embodiments. In the inertial igniter 120 of FIG. 11, the striker mass 22 has a first cam surface 22*b* at a free end thereof. A post 26*b* includes a member 122 having a second cam surface 122*a* in sliding contact with the first cam surface 22*b*. The member 122 has a first end 124 pivotably connected to the post 26*b* about pivot 126 and a second free end 128 which is offset from a portion 130 of the post. A torsion spring 132 is disposed at the pivot 126 to bias the second cam surface 122*a* against the first cam surface 22*b*. Furthermore, the portion 130 of the post 26*b* is weakened, such as being perforated around its periphery 134 such that it can be punched out from the post 26*b* upon the free end 128 exerting a predetermined force against the portion 130.

During the firing, the inertial igniter 120 is considered to be subjected to setback acceleration in the direction of the arrow 27. Acceleration in the direction of the arrow 27 will act on the inertia of the inertia of the striker mass 22, and generate a downward force that would tend to rotate the same in the clockwise direction and rotate the member 122 against the biasing force of the torsional spring 132. A torsional preloading of the spring 132 will, however, resist the clockwise rotation of the striker mass 22. The level of torsional preloading of the spring 132 is selected such that with the no-fire acceleration levels, the inertia force acting on the member 122 would not overcome the preloading force of the spring 132 and/or the force necessary to punch out the portion 130. As a result, the inertial igniter 120 is ensured to satisfy its prescribed no-fire requirement.

When the striker mass 22 is pressed down towards the base element 21 due to all-fire acceleration in the direction of the arrow 27 acting on the inertia of the striker mass 22. The first cam surface 22*b* presses on the second cam surface 122*a* to force the free end 128 into the portion 128 of the post 26*b*. Once the portion 128 is punched out from the post 26*b*, the striker mass 22 is released and allowed to be accelerate in the clockwise rotation. As a result, for a properly designed inertial igniter (i.e., by selecting a proper mass and moment of inertial for the striker mass 22, the required range of counter-clockwise rotation for the striker mass 22 so that it would gain enough energy, considering the all-fire acceleration level and the preloading level of the spring 132, the striker mass 22 will gain enough energy to initiate the pyrotechnic material 30 between the pinching points provided by the protrusions 31 and 32 on the base element 21 and the bottom surface of the striker mass 22. The ignition flame and sparks can then travel down through the opening 33 provided in the base element 21. When assembled in a thermal battery similar to the thermal battery 16 of FIG. 1, the inertial igniter is mounted in the housing 10 such that the opening 33 is lined up with the opening 12 into the thermal battery 11 to activate the battery by igniting its heat pallets.

Figure 12:
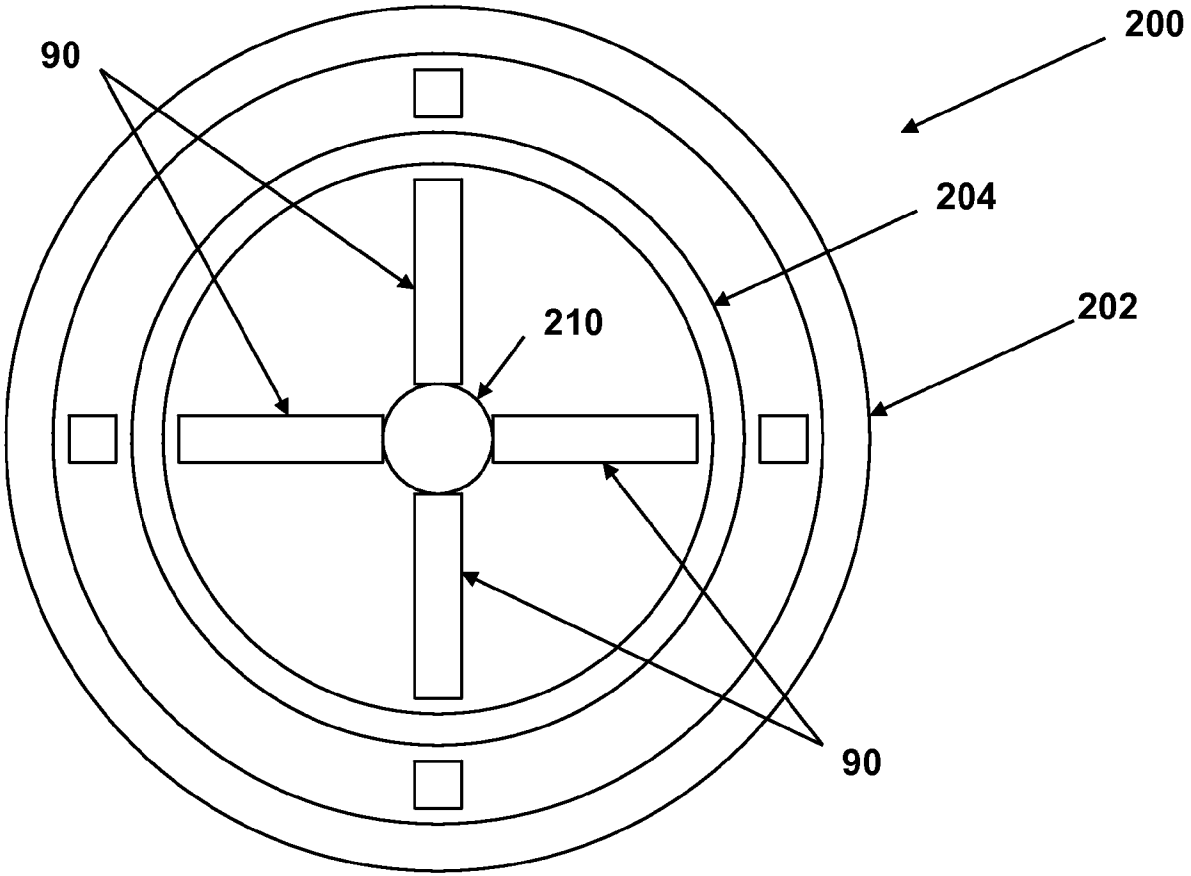
FIG. 12 illustrates a top view of an embodiment employing multiple inertial igniters.
Figure 13:
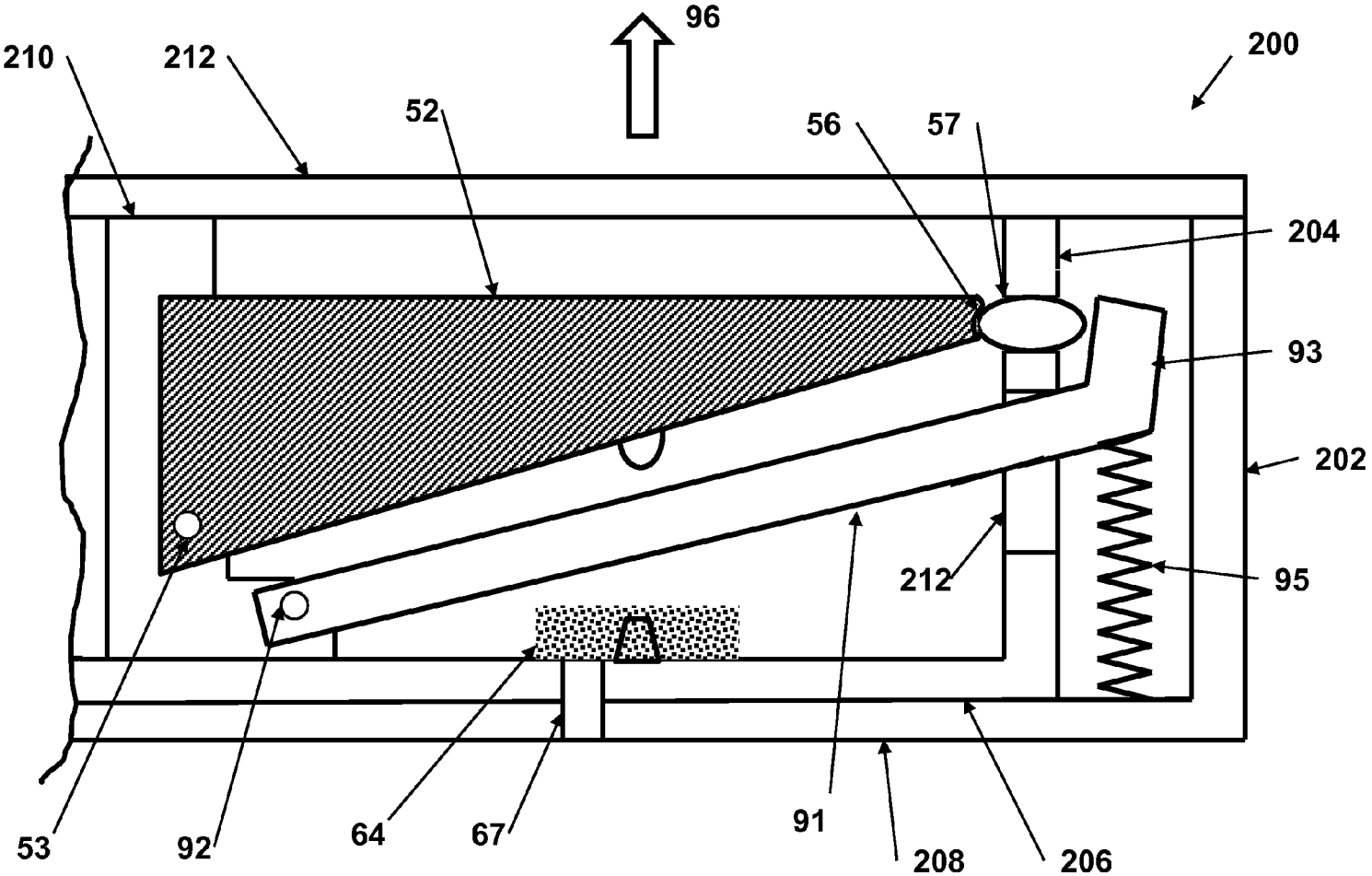
FIG. 13 illustrates schematic of a partial cross-section of the multiple inertial igniter embodiment of FIG. 12.

Referring now to FIGS. 12 and 13, therein is illustrated a multiple inertial igniter embodiment, generally referred to by reference numeral 200 in which similar elements are referred to with similar reference numerals from previous embodiments. Although the inertial igniter 90 of FIG. 7 is used to describe such multiple inertial igniter embodiment, it will be appreciated that any of the previous embodiments described above can be used, and each of the individual inertial igniters can be the same or more than one type of inertial igniter discussed above can be employed. Further, while the inertial igniter 200 of FIGS. 12 and 13 is described with regard to four inertial igniters, it will also be appreciated that any number more than one can be employed. The inertial igniter 200 is illustrated in FIG. 12 without a top cover 212 (which optional, but nonetheless not shown in FIG. 12 so as to be able to view the components therein).

The inertial igniter 200 of FIGS. 12 and 13 is configured as a cylinder, but can be any shape or size. The inertial igniter 200 includes a first cylinder 202 and second cylinder 204, where the first cylinder 202 has a larger diameter than the second cylinder 204. For ease of manufacturing, each of the first and second cylinders 202, 204 have a closed bottom 206, 208, respectively. However, they can share a common bottom or use a surface of the thermal battery as a bottom.

The inertial igniters 90, are distributed about a central post 210 about which the striker mass 52 and lever element 91 are pivotably connected (about pivots 53 and 92, respectively). The spring element 95 is disposed in a space between the first and second cylinders 202, 204 to bias the lever element in the position shown in FIG. 13. The lever element is disposed in a slot 212 formed in the second cylinder so as to be able to rotate about the pivot 92. The lever element can be biased directly against the ball 57, as shown in FIG. 7, or spaced therefrom, as shown in FIG. 13.

During the firing, the inertial igniters 90 are considered to be subjected to setback acceleration in the direction of the arrow 96. Acceleration in the direction of the arrow 96 will act on the inertia of the inertia of the lever element 91, and generate a downward force that would tend to rotate the lever element 91 in the clockwise direction. The compression preloading of the spring element 95 will, however, resists the clockwise rotation of the lever element 91. The level of compressive preloading of the spring element 95 is selected such that with the no-fire acceleration levels, the inertia force acting on the lever element 91 would not overcome the preloading force of the spring element 95. As a result, the inertial igniter 90 is ensured to satisfy its prescribed no-fire requirement.

Now if the acceleration level in the direction of the arrow 96 is high enough, then the aforementioned inertia force acting on the lever element 91 will overcome the preloading force of the spring element 95, and will begin rotate in the clockwise direction. Now if the acceleration level is applied over a long enough period of time as well, i.e., if the all-fire condition is satisfied, then the lever element 91 will have enough time to rotate enough in the clockwise direction to allow the locking ball 57 to be pushed out of the dimple 56, thereby releasing the striker mass 52 and allowing it to be accelerated in the clockwise rotation. As a result, for a properly designed inertial igniter 90 (i.e., by selecting a proper mass and moment of inertial for the striker mass 52 and range of clockwise rotation for the striker mass 52 so that it would gain enough energy), the striker mass 52 will gain enough energy to initiate the pyrotechnic material 64 between the pinching points provided by the protrusions 65 and 66 on the base element 51 and the bottom surface of the striker mass 52, respectively, as shown in the schematic of FIG. 4. The ignition flame and sparks can then travel down through the opening 67 provided in the base element 51. When assembled in a thermal battery similar to the thermal battery 16 of FIG. 1, the inertial igniter is mounted in the housing 10 such that the openings 67 are lined up with corresponding openings 12 into the thermal battery 11 to activate the battery by igniting its heat pallets.

The multiple inertial igniters 90 increase the reliability of the overall igniter 200 since only one has to initiate in order to produce the required spark to ignite the thermal battery. Furthermore, the springs and/or striker masses can be the same for each of the inertial igniters 90 in the multiple inertial igniter 200 of vary between inertial igniters 90.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for igniting a thermal battery upon a predetermined acceleration event, the method comprising:

rotatably connecting a striker mass to a base;

aligning a first projection on the striker mass with a second projection on the base such that when the striker mass is rotated towards the base, the first projection impacts the second projection; and preventing impact of the first and second projections unless the predetermined acceleration event is experienced;

wherein the preventing comprises movably disposing a retaining member at least partially in the striker mass and movably disposing a blocking member in a blocking position for blocking the retaining member from moving from the striker mass unless the predetermined acceleration event is experienced.

2. The method of claim 1, further comprising biasing the striker mass in a biasing direction away from the base.

3. The method of claim 1, further comprising limiting the movement of the striker mass in the biasing direction.

4. The method of claim 1, wherein the blocking member is slidingly disposed relative to the base.

5. The method of claim 1, wherein the blocking member is rotatably disposed relative to the base.

* * * * *